US005310466A

United States Patent [19]

La Riviere et al.

[11] Patent Number: 5,310,466

[45] Date of Patent: May 10, 1994

[54] ELECTROLYTIC METAL RECOVERY SYSTEM

[75] Inventors: John La Riviere, Beaconsfield; Bernard Gravel, Pointe-Claire; Gordon Bathurst, Beaconsfield, all of Canada

[73] Assignee: Metafix Inc., Quebec, Canada

[21] Appl. No.: 13,712

[22] Filed: Feb. 4, 1993

Related U.S. Application Data

[63] Continuation-in-part of Ser. No. 838,353, Feb. 19, 1992, abandoned.

[51] Int. Cl.[5] ..... C25C 1/20; C25C 7/06

[52] U.S. Cl. ..... 204/228; 204/109

[58] Field of Search ..... 204/109, 228

[56] References Cited

U.S. PATENT DOCUMENTS

| | | | |
|---|---|---|---|
| 4,612,102 | 9/1986 | Brimo et al. | 204/228 |
| 4,619,749 | 10/1986 | Nusbaum | 204/228 |
| 4,675,085 | 6/1987 | Vasquez | 204/105 R |
| 4,728,407 | 3/1988 | Nusbaum | 204/228 |
| 4,762,598 | 8/1988 | Drew | 204/104 |
| 4,776,931 | 10/1988 | Hardy | 204/105 R |
| 5,007,993 | 4/1991 | Hull et al. | 204/228 |
| 5,102,513 | 4/1992 | Pelkus | 204/228 X |
| 5,181,154 | 1/1993 | Haupt et al. | 204/228 X |

*Primary Examiner*—Donald R. Valentine

*Attorney, Agent, or Firm*—Fishman, Dionne & Cantor

[57] ABSTRACT

The system is operable in either a standby mode, having associated with it a predetermined standby current level, or a plating mode, having associated with it a predetermined plating current level. The system also has associated with it a cut-off current level at which the system is transferred from the plating mode to the standby mode, and a come-on current level at which the system is transferred from the standby mode to the plating mode. A variable voltage generator impresses a voltage across the electrolytic solution, and this voltage is monitored by a microcontroller. The voltage for each mode is the voltage which will produce the predetermined current for that mode. When the microcontroller determines that the voltage has remained stable, that is, with a deviation less than ±5% for a predetermined period of one minute, then the microcontroller will provide a signal to the voltage generator to initiate a change of mode.

24 Claims, 7 Drawing Sheets

ELECTROLYTIC METAL RECOVERY SYSTEM

CROSS-REFERENCE TO RELATED APPLICATION

This application is a continuation-in-part of Application Ser. No. 838,353, filed Feb. 19, 1992, now abandoned.

BACKGROUND OF INVENTION

1. Field of the Invention

In its most general aspect, the invention relates to a system for carrying out a process by sensing the conductivity of a fluid, the process being carried out in different modes dependent on the conductivity of the fluid, and for regulating and stabilizing the power supply to provide a current level for each mode which current level is appropriate to prevailing conditions.

In a specific case, the invention relates to a silver recovery system being operable in either a standby mode, having associated with it a predetermined standby current level, or a plating mode, having associated with it a predetermined plating current level. More specifically, the invention relates to such a silver recovery system wherein there is provided a standby voltage level, for causing the standby current level, and a plating voltage level, for causing the plating current level, and means for regulating the standby voltage level and the plating voltage level respectively in accordance with prevailing conditions.

In the present disclosure, the system is described as being embodied in a silver recovery system.

2. Description of Prior Art

Systems for recovering metals from solution by an electrolytic process as well known in the art, and an interesting and informative history and description of such systems is given at columns 1 and 2 of U.S. Pat. No. 4,776,931, Hardy, Oct. 11, 1988. In this patent, Hardy also describes his own system wherein a plating voltage is reduced to a lower standby voltage if the plating current falls below a threshold value. The standby voltage is periodically increased to its higher plating value for brief intervals to test the current at the higher voltage during these intervals. If the current drawn during any interval is higher than the threshold current level, then the voltage remains at the plating voltage. If it is below the threshold, then the voltage once again drops to the standby level until another sample is to be taken.

The problem with the Hardy system is that both the standby voltage and the plating voltage are predetermined and remain unvaried in spite of prevailing conditions.

This two-stage high-voltage/low-voltage system assumes that conditions are such that the high voltage will always deliver a predetermined plating current, and that the low voltage will deliver a predetermined standby current. However, this does not take into account deterioration of the plating cell occasioned by, for example, electrode oxidation, pH variants, sulphite levels, flow rates, etc. due to which a predetermined voltage will not necessarily, after time, deliver the same predetermined current that it did before the onset of deterioration. These points are also discussed to some extent in the Hardy patent.

U.S. Pat. No. 4,612,102, Brimo et al, Sept. 16, 1986, also teaches a two-stage high-voltage/low-voltage silver recovery system. In the Brimo et al patent, the conductivity of the electrolyte is monitored (by monitoring the current flow) and the driving voltage is set to either a plating voltage or a standby voltage depending on the state of the conductivity of the current. Brimo et al, as Hardy, also assumes that a predetermined voltage will always cause a predetermined current to flow which, as above pointed out, is untrue. The Brimo et al patent is further discussed in columns 1 and 2 of the Hardy patent above referred to.

Other silver recovery systems known in the art are described in, for example, U.S. Pat. No. 4,762,598, Drew, Aug. 9, 1988, U.S. Pat. No. 4,675,085, Vasquez, Jun. 23, 1987 U.S. Pat. No. 4,619,749, Nusbaum, Oct. 28, 1986, and U.S. Pat. No. 5,102,513, Pelkus, Apr. 7, 1992.

The '598 patent describes a silver recovery system which provides a means for counter-acting the ripple of the plating current by providing a current which is sufficient to maintain plating but not high enough to permit the formation of silver sulphide. This is accomplished by controlling the mean value of the current.

In the '085 silver recovery system, the anode and cathode are maintained in a fixed spaced relationship in a casing. The plating voltage, which will be increasing due to increase in resistance of the is monitored until it reaches a predetermined reference value. At that time, a drain is opened to drain the metal containing solution from the casing.

The '749 patent teaches a silver recovering system which has both primary and secondary electrodes. The plating current is correctively changed by detection logic in response to excessive variation in the electrolytic resistance of the liquid.

Pelkus teaches, in the '513 patent, the step of monitoring current and voltage to determine whether there is sufficient silver in solution to continue silver recovery. When the silver of below a predetermined value, a "lock-out" condition is triggered. During this period, no voltage is applied except when sampling. In this regard after "lock-out", further silver will be added to the solution and the content of silver in solution will be monitored at sampling intervals.

As can be seen, none of the references, or any other references known to Applicant, or any systems known to Applicant, provide means for regulating the voltage in the different modes of operation to provide predetermined and desired current levels at these different modes.

SUMMARY OF INVENTION

It is an object of the invention to provide a system for carrying out a process by sensing the conductivity of a fluid, the process being carried out in a plurality of different modes dependent on the conductivity of the fluid, and for regulating and stabilizing the power supply to provide a current level for each mode which current level is appropriate to prevailing conditions.

It is a further object of the invention to provide an electrolytic recovery system for removing an element from a solution which operates in at least two modes, wherein, in each mode, the voltage is regulated to provide a predetermined and desirable current level for each operating mode.

In accordance with the invention, the voltage is varied for a predetermined period at the beginning of each mode (the regulatory period) to maintain the predetermined current level during the regulatory period. At the end of the regulatory period, the voltage is "locked-in" and remains at the locked-in value for the duration of the time during which the system remains within the operating limits of that operating mode.

In accordance with a further embodiment of the invention, the voltage is varied until it is stabilized during the regulatory period while maintaining a predetermined current level during the regulatory period. The regulatory period ends when the voltage has been stabilized, and the voltage is then "locked-in" and remains at the "locked-in" value for the duration of the time during which the system remains within the operating limits of that operating mode.

The electrolytic recovery system may comprise a silver recovery system.

In accordance with a particular embodiment of the invention there is provided a system for carrying out a process by sensing the conductivity of a fluid, the process being carried out in a plurality of different modes dependent on the conductivity of the fluid;

said system comprising;

a power supply;

a means for regulating and stabilizing the power supply to provide a current level for each mode which current level is appropriate to prevailing conditions.

In accordance with a further particular embodiment of the invention there is provided an electrolytic metal recovery system for recovering metal from an electrolytic solution;

said metal recovery system being operable in either a standby mode having associated with it a predetermined standby current level, or a plating mode having associated with it a predetermined plating current level;

said metal recovery system also having associated with it a cut-off current level at which said metal recovery system is transferred from said plating mode to said standby mode, and a come on current level at which said metal recovery system is transferred from said standby to said plating mode;

said metal recovery system comprising;

a variable voltage generator for impressing a voltage across said solution;

standby voltage generator regulator means for adjusting the voltage level of said variable voltage generator, during a standby mode regulatory period, to a standby voltage level; and means for fixing said variable voltage generator to said standby voltage level during said standby mode.

In accordance with a still further particular embodiment of the invention there is provided an electrolytic metal recovery system for recovering metal from an electrolytic solution;

said metal recovery system being operable in either a standby mode having associated with it a predetermined standby current level, or a plating mode having associated with it a predetermined plating current level;

said metal recovery system also having associated with it a cut-off current level at which said metal recovery system is transferred from said plating mode to said standby mode, and a come-on current level at which said metal recovery system is transferred from said standby to said plating mode;

said metal recovery system comprising;

a variable voltage generator for impressing a voltage across said solution;

the voltage level of said variable voltage generator, during a plating mode regulatory period, to a plating voltage level; and means for fixing said variable voltage generator to said plating voltage level during said plating mode.

In accordance with a still further particular embodiment of the invention there is provided an electrolytic metal recovery system for recovering metal from an electrolyte solution;

said metal recovery system being operable in either a standby mode having associated with it a predetermined standby current level, or a plating mode having associated with it a predetermined plating current level;

said metal recovery system also having associated with it a cut-off current level at which said system is transferred from said plating mode to said standby mode, and a come-on current level at which said mode;

said metal recovery system comprising;

a variable voltage generator for impressing a voltage across said solution;

voltage generator regulator means for adjusting the voltage lvel of said variable voltage generator, during a standby mode regulatory period, to a standby voltage level, and during a plating mode regulatory period to a plating voltage; and means for fixing said variable voltage generator to said standby voltage level during said standby mode, and to said plating voltage level during said plating mode.

In accordance with a still further particular embodiment of the invention there is provided an electrolyte metal recovery system for recovering metal from an electrolytic solution;

said metal recovery system being operable in either a standby mode having associated with it a predetermined standy current level, or a plating mode having associated with it a predetermined plating current level;

said metal recovery system also having associated with it a cut-off current level at which said metal recovery system is transferred from said plating mode to said standby mode, and a come-on current level at which said metal recovery system is transferred from said standby mode to said plating mode;

said metal recovery system comprising:

variable voltage generator for impressing a voltage across said solution;

means for generating a constant current equal to said standby current, said means for generating a constant current being powered by a standby current driving voltage;

means for monitoring said standby current driving voltage until it attains a standby current stabilized value;

means for fixing said variable voltage to said standby current stabilized value during said standby mode.

In accordance with a still further particular embodiment of the invention there is provided an electrolytic metal recovery system for recovering metal from an electrolytic solution;

said metal recovery system being operable in either a standby mode having associated with it a predetermined standby current level, or a plating mode having associated with it a predetermined plating current level;

said metal recovery system also having associated with it a cut-off current level at which said metal recovery system is transferred from said plating mode to said standby mode, and a come-on current level at which said metal recovery system is transferred from said standby to said plating mode;

said metal recovery system comprising;

a variable voltage generator for impressing a voltage across said solution;

means for generating a constant current equal to said plating current, said means for generating a constant current being powered by a plating current driving voltage;

means for monitoring said plating current driving voltage until it attains a plating current stabilized value; and means for fixing said variable voltage generator at said plating current stabilized value during said plating mode.

In accordance with a still further particular embodiment of the invention there is provided an electrolytic metal recovery system for recovering metal from an electrolytic solution;

said metal recovery system being operable in either a standby mode having associated with it a predetermined standby current level, or a plating mode having associated with it a predetermined plating current level;

said metal recovery system also having associated with it a cut-off current level at which said system is transferred from said plating mode to said standby mode, and a come-on current level at which said system is transferred from said standby to said plating mode;

said metal recovery system comprising;

a variable voltage generator for impressing a voltage across said solution;

means for generating a constant current equal to said standby current during said standby current mode and equal to said plating current during said plating mode, said means for generating a constant current being powered by a standby current driving voltage and a plating mode driving voltage respectively;

means for monitoring said standby current driving voltage until it attains a standby current stabilized value and for monitoring said plating current driving voltage until it attains a plating current stabilized value; and means for fixing said variable voltage generator to said standby current stabilized value during said standby mode, and to said plating current stabilized value during said plating mode.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
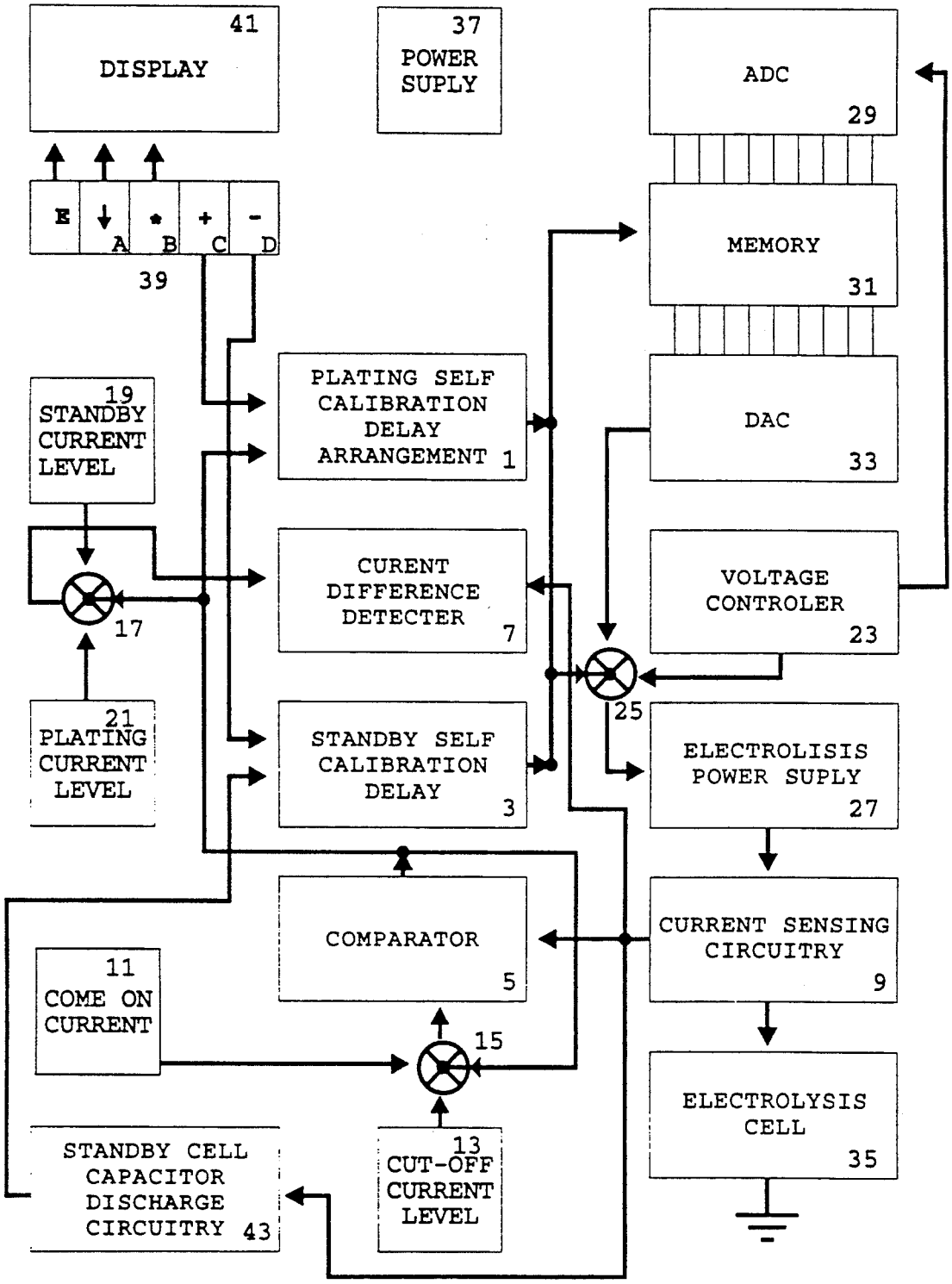
FIG. 1 is a block diagram of one embodiment of a system in accordance with the invention.

Referring to FIG. 1, the system includes a standby self-calibration arrangement 3. The delay arrangements 1 and 3 are timing devices which acquire one state at the beginning of a predetermined time interval and acquire a second state at the end of the predetermined time interval. The time intervals of the delay arrangements 1 and 3 need not be the same although they may so be.

The system also includes a comparator 5 and a difference detector 7. One input of the comparator is fed from an output of a current sensing circuitry 9. The current sensing circuitry 9 measures the current flowing through the electrolytic solution and sensing circuits for sensing current are well known in the art and are discussed to some extent in the references above-discussed.

The other input to the comparator is fed from either come-on current level 11 or cut-off current level 13 through two-position switch 15. The levels of current generated by the levels 11 and 13 are discussed below.

The output of the comparator 5 is fed to the control input of two-position switch 15 to change the position of this switch. It is also fed to the standby self-calibration delay arrangement 3 and, in parallel, to the plating self-calibration delay arrangement 1. Finally, the output of comparator 5 is fed to the control input of a second two-position switch 17, once again, for changing the position of the switch.

The output of the current sensing circuitry 9 is also fed to the difference detector 7. As can be seen, the difference detector is fed, at a second input thereof, from either the standby current level 19 or the plating current level 21. Difference detector 7 is a device whose output is proportional to the difference between its two inputs. Thus, as the difference between the two inputs of the difference detector 7 increases, the output of the difference detector 7 increases, and vice-versa.

The output of the difference detector 7 is fed to an input of voltage controller 23. One output of voltage controller 23 is fed to an input of two-position switch 25. As can be seen, the control terminal of the two-position switch 25 is connected to the respective outputs of delay arrangements 1 and 3. The output of two-position switch 25 is connected to an electrolysis power supply 27.

A second output of voltage controller 23 is fed to analog-to-digital converter (ADC) 29. The analog 29, to a digital signal, and the digital signal is transferred, by parallel line outputs from the ADC and under predetermined conditions, to memory means 31. The output of the memory means is then connected, again under predetermined conditions, to digital-to-analog converter 33 whose analog output is fed to a second terminal of two-position switch 25.

The electrolysis power supply 27 is connected the anode and cathode of the electrolysis cell 35 and the current sensing circuitry senses the current in the electrolysis cell 35. In this sense, the connection of elements 27, 9 and 35 in FIG. 1 is more a logical illustration than it is an illustration of a physical embodiment.

Logic power supply 37 provides power for the logic elements of the system, and device 39, together with display 41, provides a means for displaying the cut-off current, by pressing button 39A, or the plating current, by pressing button 39B. When button 39C of device 39 is pressed, the system is forced into the plating mode, and when button 39D of device 39 is pressed, the system is forced into the standby mode. A standby cell capacitor discharge circuitry 43, whose output is connected to standby cell calibration delay arrangement 3, is provided for reasons to be discussed below.

In operation, when the system is first turned ON, the system is in the standby mode so that the standby self-calibration delay arrangement 3 is ON. Switch 15 is adjusted so that the come-on current level 11 is connected to comparator 5, and switch 17 is adjusted so that the standby current level 19 is connected to the difference detector 7. Switch 25 is adjusted so that the voltage controller 23 is connected to the electrolysis power supply 27.

The output of the current difference detector 7, under these conditions, is the difference between a predetermined standby current level and the actual current sensed in the electrolysis cell. As, at the onset, the sensed current will be less than the standby current, the difference detector 7 will drive the voltage controller 23 to increase the voltage so that the sensed current will be equal to the predetermined current level, that is, the system tends to drive the difference between the sensed current and the predetermined standby current level to zero. As in any feedback level, the control variable will vary above and below its desired value and then settle down to a level compatible with the desired level. Thus, after some time, the voltage controller 23 will be providing a control signal to the electrolysis power supply 27 whereby the current down in the electrolysis cell will be equal to the standby current level.

During the standby self-calibration delay interval, the output of the voltage controller 23 is also fed to ADC 29, and the content of memory 31 is altered to conform with the output of ADC 29. The content of memory 31 alters the content of DAC 33 during this interval. However, as the output of DAC is not connected to anything, during this interval, the changing output of DAC 33 does not in any way affect the operation of the system.

At the termination of the standby self-calibration delay interval, delay arrangement 3 changes state to thereby provide a signal to swtich 25 to alter the position of two-position switch 25 so that the output of DAC 33 is now connected to the control terminal of electrolysis power supply 27. At the same time, delay arrangement 3 provides a signal to memory 31 so that memory 31 is frozen (disconnected from ADC 29) and so that the memory 31 has as its contents the digital value of the last voltage controller level "read" by ADC 29. Thus, the output of DAC 33 will also remain frozen so that the control level for electrolysis power supply 27 remains frozen so that the output of electrolysis power supply 27 also remains frozen. The above values will then remain frozen during the entire interval in which the apparatus remains within the operating limits of the standby mode of operation.

It can thus be seen that the voltage provided by the electrolysis power supply was regulated, during the standby self-calibration delay interval, or the standby regulatory interval, at a voltage which will produce a predetermined standby current level. As the performance of .he electrodes alter, it may be necessary to provide a higher voltage to produce the same predetermined standby current level. This is automatically attended to by the regulatory means as above-described. Thus, in spite of prevailing predetermined standby current level by altering the voltage level necessary to produce such a current level.

It will also be seen that the regulation took place at the beginning of the standby mode interval, and that the voltage is frozen to the voltage at the end of the regulatory period and remains at the same level during the entire interval in which the apparatus remains within the operating limits of the standby mode.

Immediately following the regulatory period, the comparator 5 comes into play. As can be seen, the comparator is comparing the sensed current with the come-on current level. The come-on current level is somewhat higher than the standby current level.

It is well known, from the above references, that the apparatus should remain in its standby mode when there is insufficient metal in the solution to permit plating. It is also known that, during to thereby decrease the resistance of the solution and to, consequently, increase the current flowing through the electrolytic solution.

When the current sensed in the solution, by current sensing circuitry 9, is equal to or exceeds the come-on current level provided by 11, then comparator 5 will provide an output signal to make the following changes:

The position of switch 15 is altered so that cut-off current level 13 is connected to the second input of comparator 5.

The position of switch 17 is altered so that plating current level 21 is fed to the second input of difference detector 7.

The position of switch 25 is altered so that the output of voltage controller 23 is connected to the control terminal of electrolysis power supply 27.

Standby self-calibration delay arrangement 3 is turned OFF.

Plating self-calibration delay arrangement 1 is turned ON.

With the connections as above-dicussed, the system will tend to alter the voltage of the electrolysis power supply 27 so that the sensed current is equal to the plating current level as follows:

Once again, the output of the difference detector 7 is proportional to the difference between the plating current level and the current sensed in the electrolyte. As this difference is typically positive when the electrolysis power supply is supplying the standby voltage, the output of difference detector 7 will be positive to thereby provide a positive signal to the control terminal of voltage controller 23. As the output of the voltage controller 23 is now connected to the electrolysis power supply 27, it will provide a control voltage to increase the voltage of the electrolysis power supply 27.

Accordingly, the current in the solution will increase so that the difference between the plating current level and the sensed level will decrease to decrease the output of the voltage controller 23 to thereby decrease the increase in the output voltage of the electrolysis power supply. The voltage across the electrolyte will increase in this decreasing manner until the sensed current is equal to the plating current level. Once again, as in all feedback systems, the output voltage of the electrolysis power supply 27 will overshoot and will have to be brought back whereupon it will undershoot. The overshoot and undershoot will keep decreasing and the output voltage of the electrolysis power supply will eventually settle down to a voltage which will provide a current equal to the predetermined and desired plating current level.

The system entered into the plating mode as soon as the come-on current was detected in the comparator 5. It can therefore be seen that, once again, the voltage is regulated at the front end of the plating mode.

At the end, once again, the second output of voltage controller 23 is fed to ADC 29, and the digital output of ADC 29 is fed to the memory 31 to alter the contents of this memory. The contents of DAC 33 are altered in accordance with the alteration of the contents of memory 31.

At the conclusion of the interval set in the plating self-calibration arrangement 1, the delay arrangement 1 will change state to provide signals as follows:

A signal is provided to the control terminal of memory 31 to disconnect the memory from ADC 29 and to freeze it at its present condition.

To change the position of switch 25 so that the output of DAC 33 is connected to the control terminal of electrolysis power supply 27.

It can therefore be seen that, once again, the voltage is regulated to produce a current equal to the plating current level during the regulatory period, and that the voltage is frozen at this level during the entire interval that the system is in its present plating mode.

At the conclusion of the plating selfcalibration delay arrangement time interval, comparator 5 once again comes into play. As cut-off current level 13 is now connected to comparator 5, the sensed current will be compared with a cut-off current level. The cutoff current level is some predetermined amount below the plating current level.

As metal is being plated onto the cathode in the electrolysis cell, the resistance of the electrolytic. Solution will increase and the current will decrease. When the current falls to the cut-off current level, comparator 5 provides an output signal to make the following changes:

The position of switch 15 is altered so that the output of come-on current level 11 is connected to the second input of comparator 5.

The position of switch 25 is altered so that the output of voltage controller 23 is fed to the terminal of electrolysis power supply 27.

The position of switch 17 is altered so that the output of standby current level 19 is fed to the second input of difference detector 7.

Plating self-calibration delay arrangement 1 is turned OFF.

Standby self-calibration delay arrangement 3 is turned ON.

The plating current mode has now ended and the standby current mode has begun and the system will regulate the voltage to produce the standby current, and will remain frozen at this voltage while the system remains within the operating limits of the standby mode and until the current rises to the come-on current level as above described.

It can therefore be seen that the voltage is regulated at the beginning of each mode to provide a predetermined current level for this mode. This is in contradistinction to prior art devices which, at the beginning of each mode, provide a predetermined voltage level.

It is noted that the current levels 11, 13, 19 and 21 may be either current generators, producing the appropriate current level or generators producing a simulation of the current level, for example, a voltage level proportional to the desired current level. This will, of course, depend on the nature of the inputs required by the comparator 5 and the difference detector 7.

The purpose of the standby cell capacitor discharge circuitry 43 is to provide an initiating pulse when the system is in the standby mode and the standby current drops out of the preferred operating standby range, i.e, several milliamps below the predetermined standby current. The standby current can drop out of the preferred operating standby range after the system has been in the standby mode for an inordinate length of time. When it drops to that level, it is possible that a come-current could not be produced with the voltage as set by the electrolysis power supply 27.

In any case, when the standby self-calibration delay arrangement is turned ON, a new standby voltage will be generated so that it will once again be possible to produce a come-on current to place the system in the plating mode.

Figure 2A:
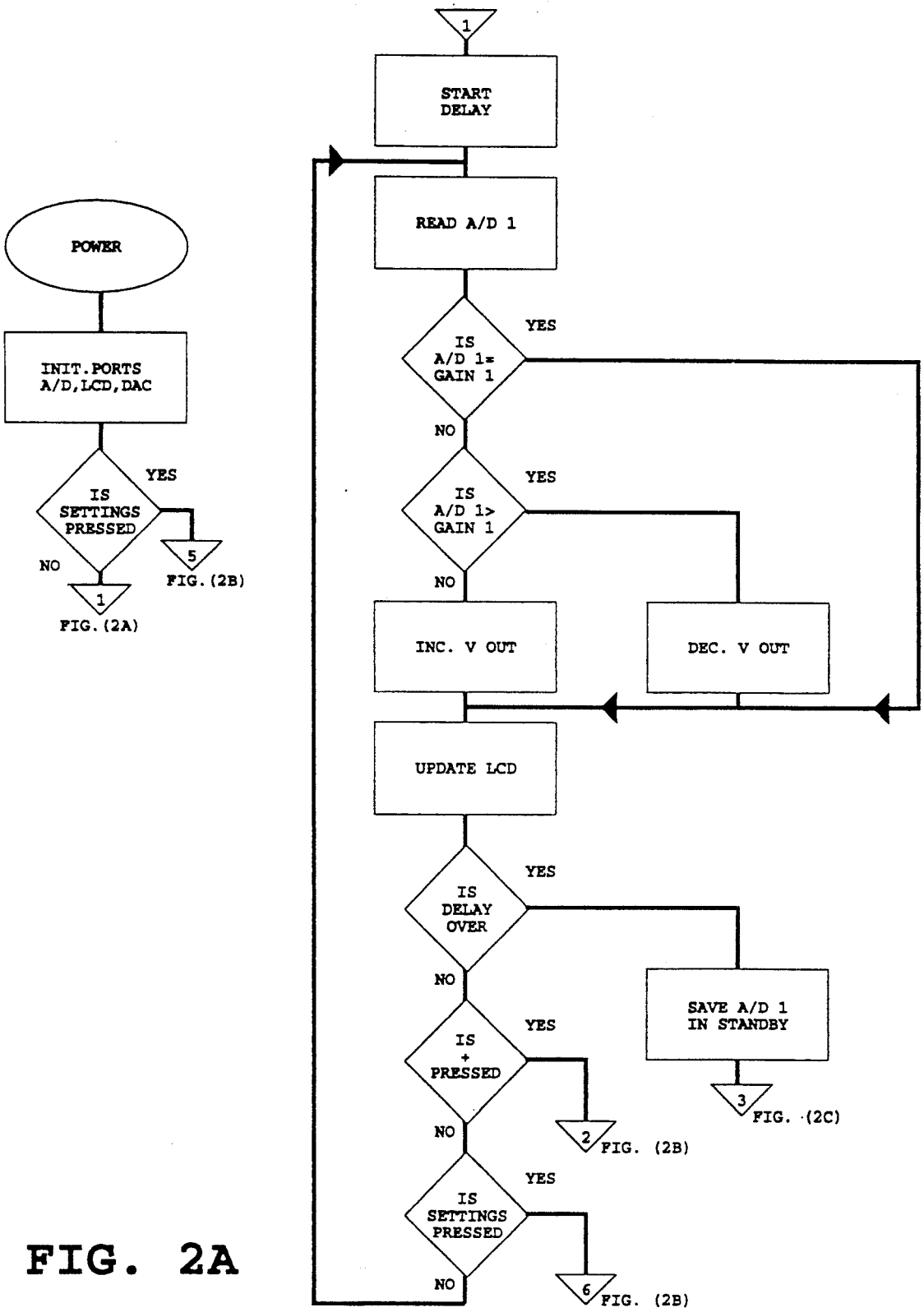
FIG. 2A–C are a flow chart for a program for driving a microprocessor in a microprocessor based embodiment of the invention.
Figure 2B:
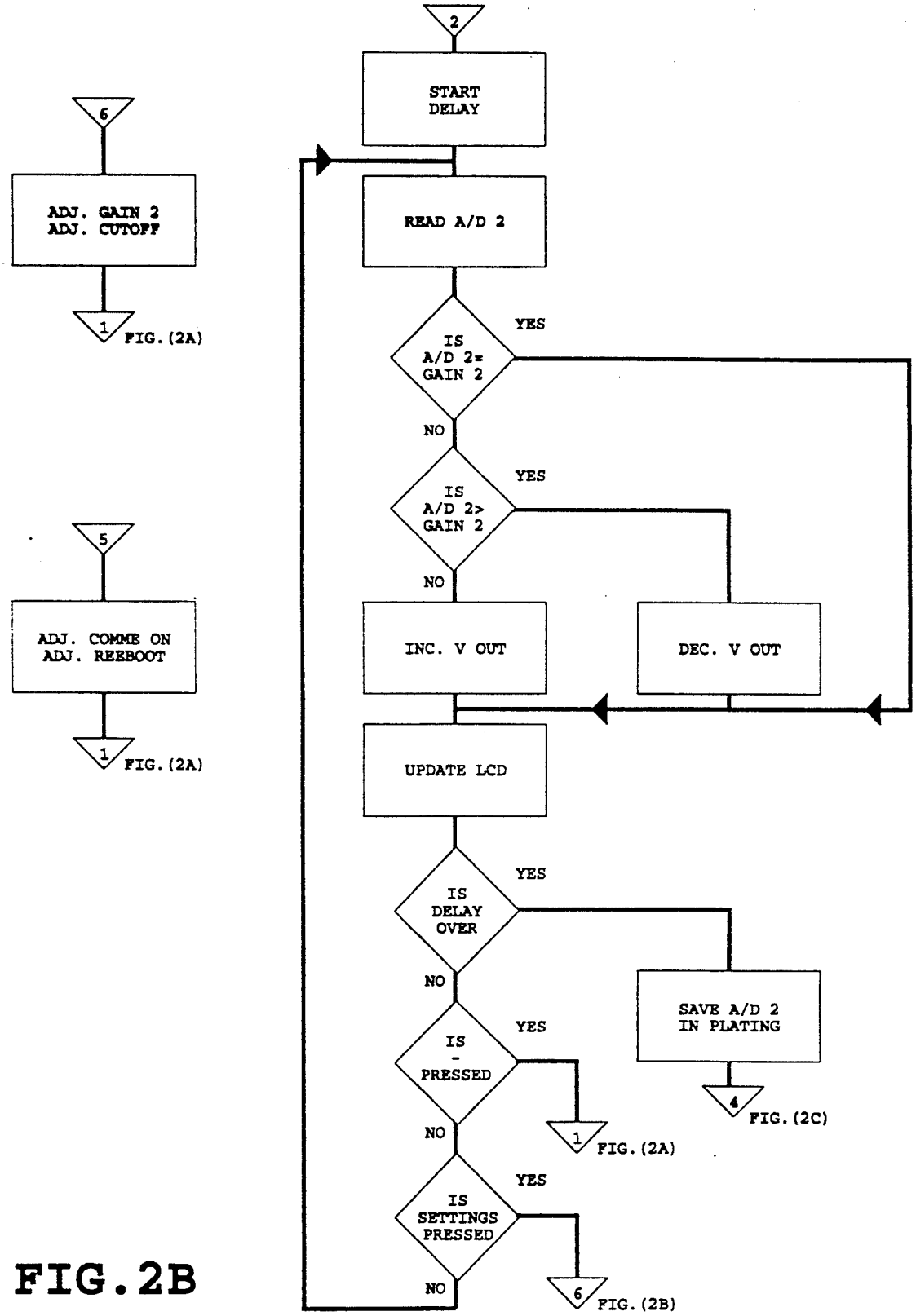
Figure 2C:
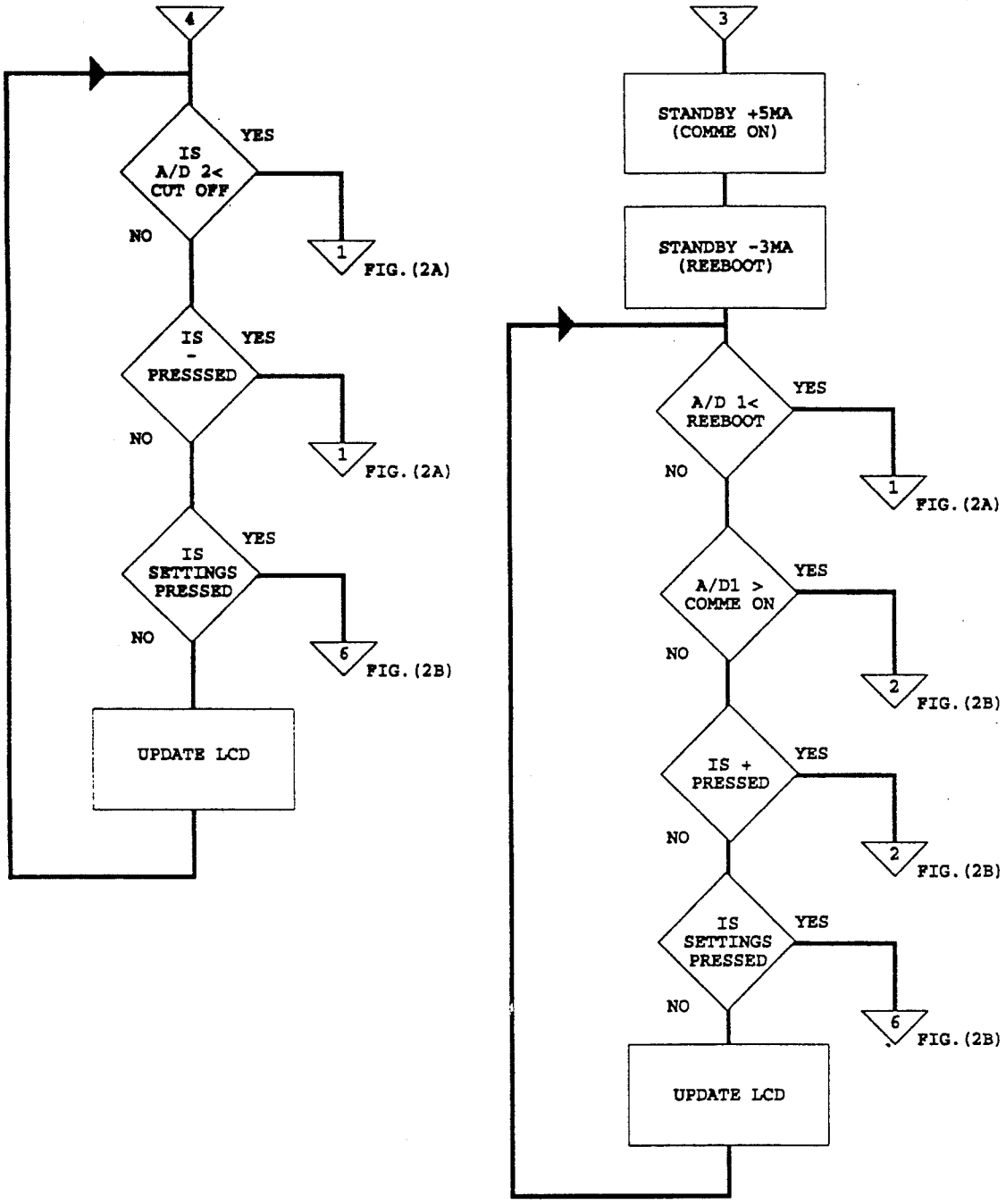

It will of course be apparent that the elements constituting the system as above-described could be replaced by a microprocessor. Under those conditions, it will of course be necessary to sense the current in the electrolytic solution, and to provide the sensed current to an appropriate input of the microprocessor. A flow chart for a program for driving the microprocessor is illustrated in FIG. 2-C hereof.

As above-mentioned, the instant system could be used in many different applications as follows:

1. Metal plating
2. Refining of precious metals.
3. As a sensor to sense conductivity changes in, for example, wash-water recycling apparatus.

When the system is used as a silver recovery system, typical parameter values are as follows:

| | |
|---|---|
| Standby current level | 30 mAmps |
| Plating current level | 2 Amps |
| Come-on current level | 40 mAmps |
| Cut-off current level | 1.35 Amps |
| Plating self-calibration delay arrangement interval | 3 min |
| Standby self-calibration delay arrangement interval | 3 min |
| Standby mode voltage | ½ volt |
| Plating mode voltage | 1.05 volt. |

In the above-described embodiment, the standby self-calibration delay and the plating self-calibration delay are selected on the basis that, at the end of the delays, the voltage which produces either the standby current or the plating current will have stabilized. This assumption is not always correct. It is possible that the delay will be too long or too short thus adversely affecting the operation of the system.

Figure 3:
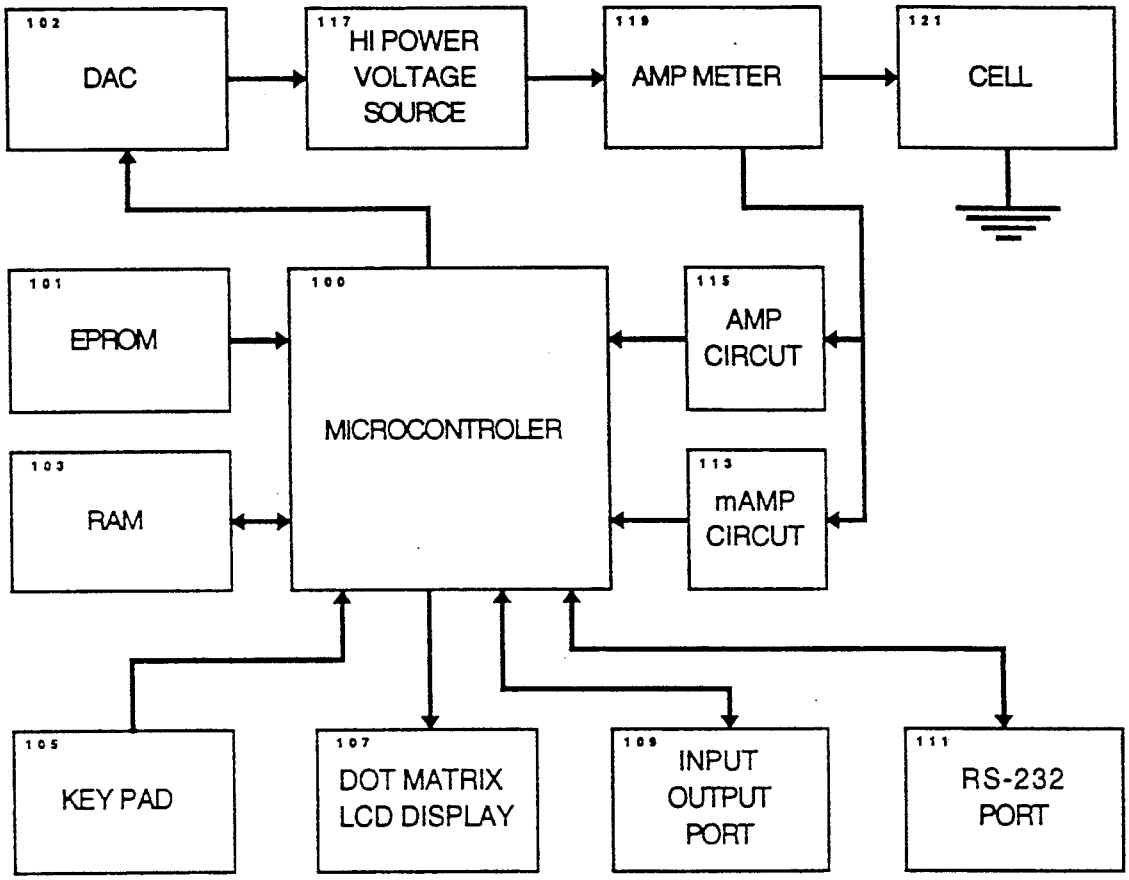
FIG. 3 is a block diagram of a second embodiment of a system in accordance with the invention.

To correct this, a second embodiment, as illustrated in FIG. 3, is provided. In the second embodiment, as will be seen below, the voltage is monitored and a change of mode is effected only after it has been determined that the voltage has been stabilized for a predetermined period of time.

Referring now to FIG. 3, the second embodiment comprises a microcontroller 100 which has associated with it an erasable, programmable read-only memory (EPROM) 101 and a random access memory (RAM) 103. The microcontroller can be fed data or programming information through keypad 105, and it will provide a visual output on display 107 which may comprise a dot matrix LCD display. The microcontroller also includes an input/output port 109 and an RS-232 port 111 for connecting the microcontroller to any standard terminal for print-out or data base.

An output of the microcontroller 100 is connected to the digital to analog converter 102, and the output of 102 is connected to the control terminal of a high-power voltage source 117. The voltage source is connected to the cell 121 through an amp meter 119. The amp meter 119 is connected to AMP circuit 115, for measuring current of the order of amperes, and to mAMP circuit 113 when current levels of the order of milliamps are being measured.

Figure 4:
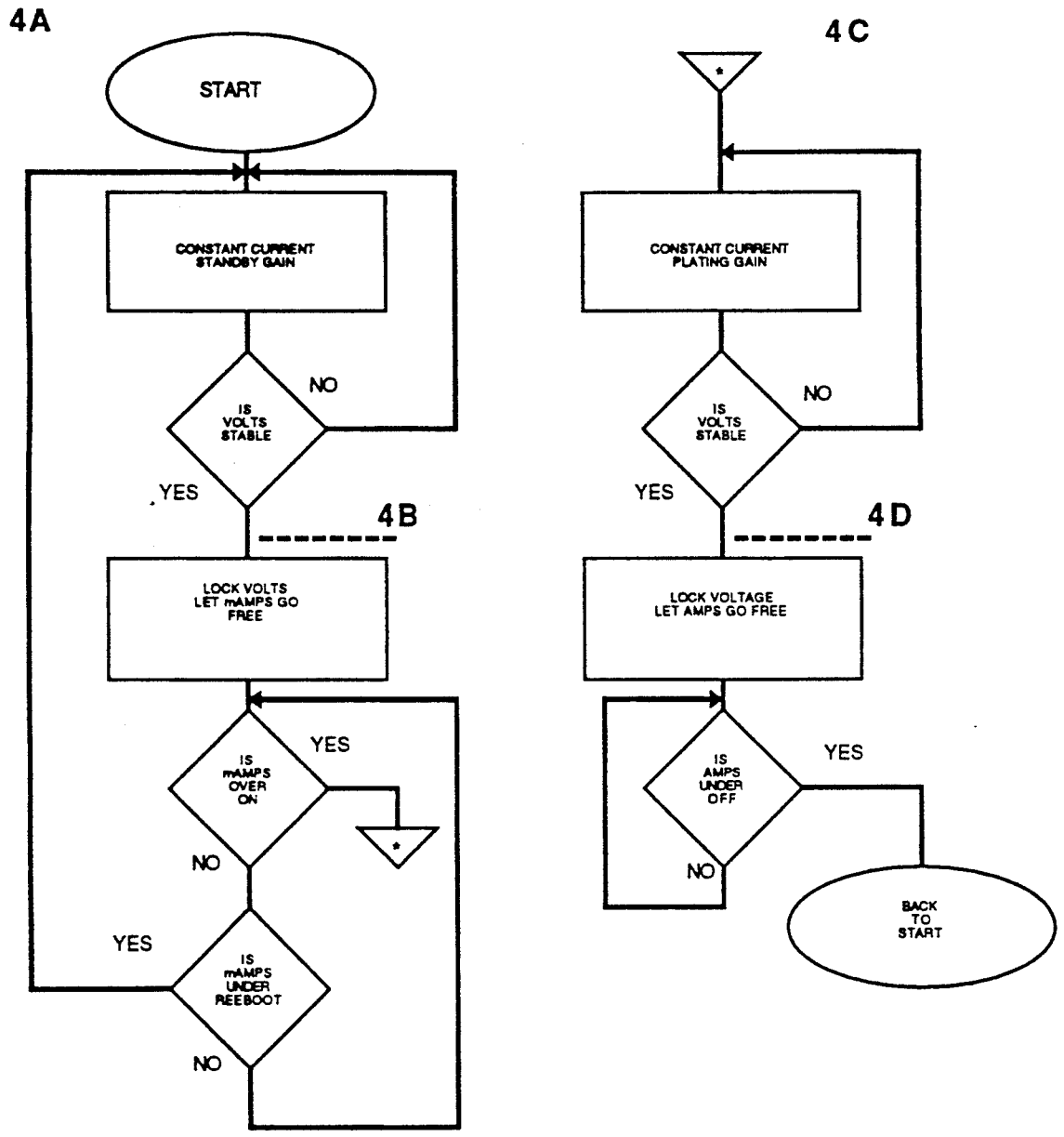
FIG. 4 is a flow chart for a program for driving the microprocessor of FIG. 3.
Figure 5:
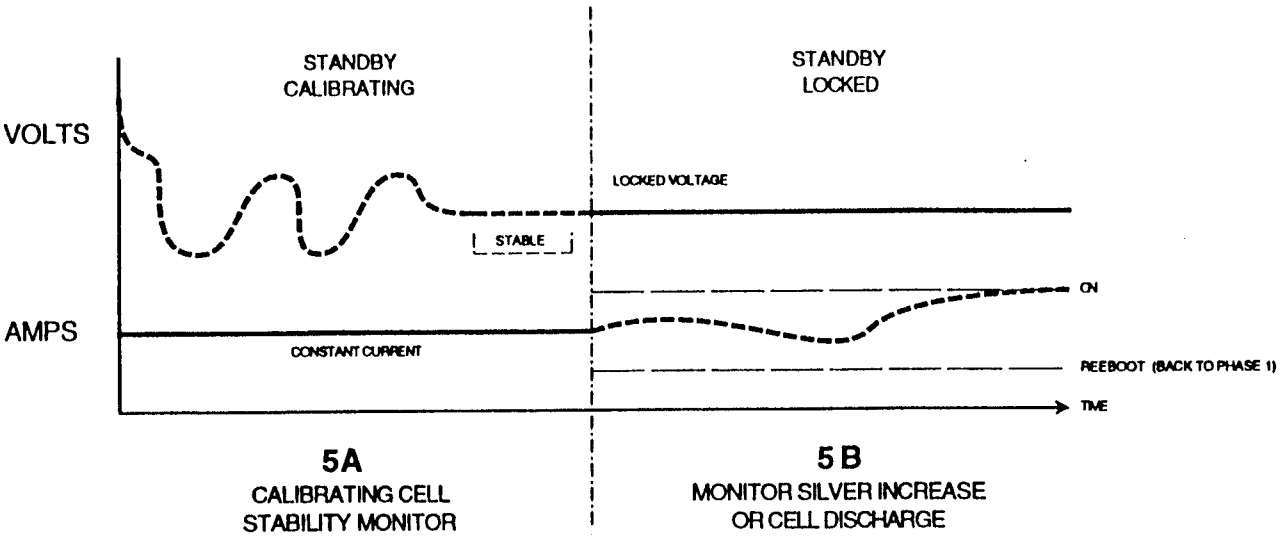
FIG. 5 is a graph useful in explaining the operation of phases 1 and 2 of the second embodiment.
Figure 6:
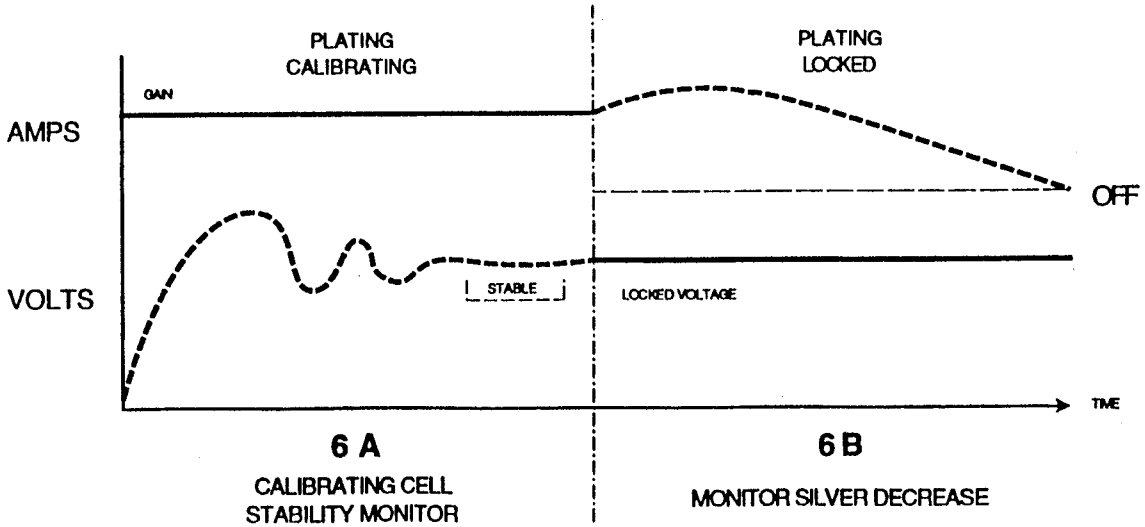
FIG. 6 is a graph useful in explaining the operation of phases 3 and 4 of the second embodiment.

To understand the operation of the second embodiment, attention is directed to FIGS. 4, 5 and 6. To start the operation, an input signal, for example from keypad 105, is input into the microcontroller. The microcontroller will then generate a constant current, equal to the standby current, and monitor the voltage necessary to produce this current. As seen in FIG. 5, phase 1, the voltage at first will vary up and down but will eventually settle down. When the microcontroller determines that the voltage has remained stable, that is, with a deviation less than ±5% for a predetermined period of one minute, then the microcontroller will provide a signal to the voltage source 117 to lock it into this stable voltage. As seen in phase 2 of FIG. 5, the voltage remains locked on to the stable voltage of phase 1 of FIG. 5.

As silver is added to the solution, the current will increase and the increase in current is a measure of increase in conductivity due to the increase in silver in the cell. The current is monitored by the AMP meter 114 and, when it reaches a come-on current (indicated in FIG. 5, phase 2 by ON), then the microcontroller once again generates a constant current and monitors the voltage for producing this constant current until this voltage remains stable as illustrated in FIG. 6, phase 3. The constant current of FIG. 6, phase 3 is the plating current.

When the voltage has reached a stable level, voltage source 117 is locked onto this voltage as shown in FIG. 6, phase 4 and the current is then monitored. When the current fails below a predetermined level, (the cut-off current level shown in FIG. 6, phase 4 as OFF) then the voltage source 117 will be turned off and the system will return to phase 1, that is, it generates a constant current equal to the standby current.

It can thus be seen that the operation of the embodiment illustrated in FIG. 3 is similar to the embodiment illustrated in FIG. 1 except that instead of generating the standby current and plating current during the regulatory period for a fixed period of time, in the second embodiment, the voltage in the regulatory period is actually monitored and a switchover is made only when it is determined that the voltage has stabilized.

The microcontroller 100 will, of course, include a microprocessor and because a microprocessor is used in this embodiment, it is possible to keep track of the length of time that the system is in the different phases of operation and the values of voltage that the system locks onto in both phases 2 and 4. It can also keep track of cumulative ampere hours and it can then convert the ampere hours to silver content recovered in the cell so that it can give a signal when it is time to harvest the silver.

As above-mentioned, it is possible to carry out the first described process with a microprocessor using a system as illustrated in FIG. 3. In that case, the timing would take place within the microcontroller 100.

It would thus in a similar manner be possible to carry out the process of the second embodiment using a system as illustrated in FIG. 1. In that case, the delay arrangement would be replaced with voltage monitoring means to determine when the voltage has reached a stable value.

Although particular embodiments have been described, this was for the purpose of illustrating, but not limiting, the invention. Various modifications, which will come readily to the mind of one skilled in the art, are within the scope of the invention as defined in the appended claims.

We claim:

1. An electrolytic metal recovery system for recovering metal from an electrolytic solution;

said metal recovery system being operable in either a standby mode having associated with it a predetermined standby current level, or a plating mode having associated with it a predetermined plating current level;

said metal recovery system also having associated with it a cut-off current level at which said metal recovery system is transferred from said plating mode to said standby mode, and a come-on current level at which said metal recovery systems is transferred from said standby mode to said plating mode;

said metal recovery system comprising;

a variable voltage generator for impressing a voltage across said solution;

standby voltage generator regulator means for adjusting the voltage level of said variable voltage generator, during a standby mode regulatory period, to a standby voltage level; and means for fixing said variable voltage generator to said standby voltage level at the end of said standby mode regulatory period;

wherein said standby voltage level is that level of voltage which will cause said predetermined standby current to flow in said system;

said system further including:

system current level sensor means for sensing the current flowing in said solution;

standby current level generator means for generating a standby current level;

current difference detector means, said system current level sensor and said standby current level generator means connected to respective inputs of said current difference detector means;

whereby, to detect the difference between said sensed system current level and said standby current level;

the output of said current difference detector means being operable to continuously adjust the voltage level of said variable voltage generator to reduce the difference detected by said current difference detector to zero.

2. A system as defined in claim 1 and further including standby self-calibration delay timer means for implementing a predetermined standby mode regulatory period time delay;

said standby voltage level comprising the level of said variable voltage generator at the end of said predetermined time delay.

3. A system as defined in claim 2 wherein said metal is silver.

4. An electrolytic metal recovery system for recovering metal from an electrolytic solution;

said metal recovery system being operable in either a standby mode having associated with it a predetermined standby current level, or a plating mode having associated with it a predetermined plating current level;

said metal recovery system also having associated with it a cut-off current level at which said metal recovery system is transferred from said plating mode to said standby mode, and a come-on current level at which said metal recovery system is transferred from said standby to said plating mode;

said metal recovery system comprising:

a variable voltage generator for impressing a voltage across said solution;

plating voltage generator regulator remains for adjusting the voltage level of said variable voltage generator, during a plating mode regulatory period, to a plating voltage level; and means for fixing said variable voltage generator to said plating voltage level at the end of said plating mode regulatory period;

wherein said plating voltage level is that level of voltage which will cause said predetermined plating current to flow in said system;

said system further including:

system current level sensor means for sensing the current flowing in said solution;

plating current level generator means for generating a plating current level;

current difference detector means, said system current level sensor and said plating current level generator means being connected to respective inputs of said current difference detector means;

whereby, to detect the difference between said sensed system current level and said plating current level;

the output of said current difference detector means being operable to adjust the voltage level of said variable voltage generator to reduce the difference detected by said current difference detector to zero.

5. A system as defined in claim 4 and further including plating self-calibration delay timer means for implenting a predetermined plating regulatory period time delay;

said plating voltage level comprising the level of said variable voltage generator at the end of said predetermined time delay.

6. A system as defined in claim 5 wherein said metal is silver.

7. An electrolytic metal recovery system for recovering metal from an electrolytic solution;

said metal recovery system being operable in either a standby mode having associated with it a predetermined standby current level, or a plating mode having associated with it a predetermined plating current level;

said metal recovery system also having associated with it a cut-off current level at which said system is transferred from said plating mode to said standby mode, and a come-on current level at which said system is transferred from said standby to said plating mode;

said metal recovery system comprising:

a variable voltage generator for impressing a voltage across said solution;

voltage generator regulator means for adjusting the voltage level of said variable voltage generator, during a standby mode regulatory period, to a standby voltage level, and during a plating mode regulatory period to a plating voltage and means for fixing said variable voltage generator to said standby voltage level at the end of said standby mode, regulatory period and to said plating voltage level at the end of said plating mode regulatory period;

wherein said standby voltage level is that level of voltage which will cause said predetermined standby current to flow in said system;

said metal recovery system further including:

system current level sensor means for sensing the current flowing in said solution;

standby current level generator means to generate a standby current level;

current difference detector means, said system current level sensor and said standby current level generator means being connected to respective inputs of said current difference detector means during said standby mode regulatory period;

whereby, to detect the difference between said sensed system current level and said standby current level during said standby mode regulatory period;

the output of said current difference detector means being operable to continuously adjust the voltage level of said variable voltage generator to reduce the difference detected by said current difference detector means to zero during said standby mode regulatory period.

8. A system as defined in claim 7 and further including standby self-calibration delay timer means for implementing a predetermined standby mode regulatory period time delay;

said standby voltage level comprising the level of said variable voltage generator at the end of said predetermined time delay.

9. A system as defined in claim 8 wherein said plating voltage level is that level of voltage which will cause said predetermined plating current to flow in said system;

said metal recovery system further including:

a plating current level generator means for generating a plating current level;

said system current level sensor and said plating current level generator means being connected to said current difference detector means during a plating mode regulatory period;

whereby to detect the difference between said sensed system current level and said plating current level during said plating mode regulatory period;

the output of said current difference detector means being operable to continuously adjust the voltage level of said variable voltage generator to reduce the difference detected by said current difference detector means to zero during said plating mode regulatory period.

10. A system as defined in claim 9 and further including plating self-calibration delay timer means or implementing a predetermined plating mode regulatory period time delay;

said plating voltage level comprising the level of said variable voltage generator at the end of said predetermined time delay.

11. A system as defined in claim 10 and further including a first two-position switch means;

said first switch means connecting, in one position thereof, said standby current level generator means to a first input of said current difference detector, and, in a second position thereof, said plating current level generator means to said first input of said current difference detector.

12. A system as defined in claim 11 and further including comparator means;

said system current level sensor means being connected to one input of said comparator means;

said system current level sensor means also being connected to a second input of said current difference detector.

13. A system as defined in claim 12 and further including;

a come-on current level generator means;

a cut-off current level generator means;

a second two-position switch means;

said second switch menas connecting, in a first position thereof, said come-on current level generator means to a second input of said comparator and, in a second position thereof, said cut-off current level generator means to said second input of said comparator.

14. A system as defined in claim 13 and further including a voltage controller;

the output of said current difference detector being connected to the input of said voltage controller;

a third two-position switch means;

one output of said voltage controller being connected to a control terminal of said variable voltage generator in a first position of said third switch means.

15. A system as defined in claim 14 and further including:

analog-to-digital converter means, a second output of said voltage controller being connected to said analog-to-digital converter means;

memory means, the output of said analog-to-digital converter means being connected to the input of said memory means; and digital-to-analog converter means, the output of said memory means being connected to the input of said digital-to-analog converter means;

the output of said digital-to-analog converter means being connected to the control terminal of said variable voltage generator through said third switch means when said third switch means is in the second position thereof.

16. A system as defined in claim 15 wherein said first switch is in said first position, said second switch is in said first position and said second switch is in said first position during said standby mode, and said third switch is in said first position during said standby mode regulatory period and in said second position during the remainder of said standby mode, said third switch being switched from said first position to said second position by said standby self-calibration self-calibration time delay.

17. A system as defined in claim 16 wherein said first switch is in said second position and said second switch is in said second position during said plating mode, and said third switch is in said first position in said plating mode regulatory period and in said second position for the remainder of said plating mode, said second position during said plating mode by said plating self-calibration delay timer means.

18. A system as defined in claim 17 wherein said comparator means switches said first switch means and said second switch means from said first position to said second position when the current detected by said system current level sensor means is equal to said common level.

19. A system as defined in claim 18 wherein said comparator switched said first switch means and second switch means from said second position to said first position when the current level sensed by said system current level sensor means is equal to said current cutoff level.

20. A system as defined in claim 19 wherein said metal is silver.

21. An electrolytic metal recovery system for recovering metal from an electrolytic solution;

said metal recovery system being operable in either a standby mode having associated with it a predetermined standby current level, or a plating mode having associated with it a predetermined plating current level;

said metal recovery system also having associated with it a cut-off current level at which said metal recovery system is transferred from said plating mode to said standby mode, and a come-on current level at which said metal recovery system is transferred from said standby mode to said plating mode;

said metal recovery system comprising;

a variable voltage generator for impressing a voltage across said solution;

means for generating a constant current equal to said standby current level, said means or generating a constant current being powered by a standby current driving voltage;

means for monitoring said standby current driving voltage until it attains a standby current stabilized value;

means for fixing said variable voltage generator to said standby current stabilized value during said standby mode;

wherein said standby voltage level is that level of voltage which will cause said predetermined standby current to flow in said system;

said system further including:

system current level sensor means for sensing the current flowing in said solution;

current difference detector means, said system current level sensor and said constant current level generator means connected to respective inputs of said current difference detector means;

whereby, to detect the difference between said sensed system current level and said standby current level;

the output of said current difference detector means being operable to adjust the voltage level of said variable voltage generator to reduce the difference detected by said current difference detector to zero.

22. An electrolytic metal recovery system for recovering metal from an electrolytic solution;

said metal recovery system being operable in either a standby mode having associated with it a predetermined standby current level, or a plating mode having associated with it a predetermined plating current level;

said metal recovery system also having associated with it a cut-off current level at which said metal recovery system is transferred from said plating mode to said standby mode, and a come-on current level at which said metal recovery system is transferred from said standby to said plating mode;

said metal recovery system comprising;

a variable voltage generator for impressing a voltage across said solution;

means for generating a constant current equal to said plating current level, said means or generating a constant current being powered by a plating current driving voltage;

means for monitoring said plating current driving voltage until it attains a plating current stabilized value; and means for fixing said variable voltage generator at said plating current stabilized value during said plating mode;

wherein said plating voltage level is that level of voltage which will cause said predetermined plating current to flow in said system;

said system further including:

system current level sensor means for sensing the current flowing in said solution;

current difference detector means, said system current level sensor and said constant current level generator means being connected to respective inputs of said current difference detector means;

whereby, to detect the difference between said sensed system current level and said plating current level;

the output of said current difference detector means being operable to adjust the voltage level of said variable voltage generator to reduce the difference detected by said current difference detector to zero.

23. An electrolytic metal recovery system for recovering metal from an electrolytic solution;

said metal recovery system being operable in either a standby mode having associated with it a predetermined standby current level, or a plating mode having associated with it a predetermined plating current level;

said metal recovery system also having associated with it a cut-off current level at which said system is transferred from said plating mode to said standby mode, and a come-on current level at which said system is transferred from said standby to said plating mode;

said metal recovery system comprising:

a variable voltage generator for impressing a voltage across said solution;

means for generating a constant current equal to said standby current level during said standby current mode and equal to said plating current level during said plating mode, said means for generating a constant current being powered by a standby current driving voltage and a plating mode driving voltage respectively;

means for monitoring said standby current driving voltage until it attains a standby current stabilized value and for monitoring said plating current driving voltage until it attains a plating current stabilized value; and means for fixing said variable voltage generator to said standby current stabilized value during said standby mode, and to said plating current stabilized value during said plating mode;

wherein said standby voltage level is that level of voltage which will cause said predetermined standby current to flow in said system;

said metal recovery system further including:

system current level sensor means or sensing the current flowing in said solution;

current difference detector means, said system current level sensor and said constant current level means being connected to respective inputs of said current difference detector means during a standby mode regulatory period;

whereby, to detect the difference between said sensed system current level and said standby current level during said standby mode regulatory period;

the output of said current difference detector means being operable to adjust the voltage level of said variable voltage generator to reduce the difference detected by said current difference detector means to zero during said standby mode regulatory period.

24. A system as define din claim 23 wherein said plating voltage level is that level of voltage which will cause said predetermined plating current to flow in said system;

said metal recovery system further including:

said system current level sensor and said constant current level means being connected to said current difference detector means during a plating mode regulatory period;

whereby to detect the difference between said sensed system current level and said plating current level during said plating mode regulatory period;

the output of said current difference detector means being operable to adjust the voltage level of said variable voltage generator to reduce the difference detected by said current difference detector means to zero during said plating mode regulatory period.

* * * * *